US005505030A

United States Patent [19]

Michalcewiz et al.

[11] Patent Number: 5,505,030

[45] Date of Patent: Apr. 9, 1996

[54] COMPOSITE REINFORCED STRUCTURES

[75] Inventors: William W. Michalcewiz, Wilmington; George C. Tunis, III, Newark; Rikard K. Haraldsson, Bear; Brock J. Vinton, Montchanin, all of Del.

[73] Assignee: Hardcore Composites, Ltd., New Castle, Del.

[21] Appl. No.: 212,059

[22] Filed: Mar. 14, 1994

[51] Int. Cl.[6] ..... E02D 37/00

[52] U.S. Cl. ..... 52/249; 52/514; 52/721.4; 52/723.1; 52/724.5; 52/736.3; 52/738.1; 52/746.1; 405/231; 405/257; 156/94

[58] Field of Search ..... 52/725, 727, 514, 52/249, 721.4, 721.5, 723.1, 723.2, 724.5, 736.3, 736.4, 738.1, 746.1; 405/256, 257, 231; 156/94

[56] References Cited

U.S. PATENT DOCUMENTS

| | | | |
|---|---|---|---|
| 3,563,276 | 2/1971 | Hight et al. | 156/94 X |
| 4,019,301 | 4/1977 | Fox | 52/725 |
| 4,071,996 | 2/1978 | Muto et al. | 52/727 X |
| 4,244,156 | 1/1981 | Watts, Jr. | 52/746 |
| 4,283,161 | 8/1981 | Evans et al. | 52/725 X |
| 4,439,071 | 3/1984 | Roper, Jr. | 405/257 X |
| 4,543,764 | 10/1985 | Kozikowski | 52/514 X |
| 4,700,752 | 10/1987 | Fawley | 138/172 |
| 4,786,341 | 11/1986 | Kobatake et al. | 52/725 X |
| 4,918,883 | 4/1990 | Owen et al. | 52/727 X |
| 4,993,876 | 2/1991 | Snow et al. | 52/725 X |
| 5,043,033 | 8/1991 | Fyfe | 156/94 X |
| 5,218,810 | 6/1993 | Isley | 52/725 |
| 5,238,716 | 8/1993 | Adachi | 52/727 X |
| 5,326,410 | 7/1994 | Boyles | 156/94 X |
| 5,380,131 | 1/1995 | Crawford | 52/725 X |
| 5,438,812 | 8/1995 | Erickson | 52/736.3 |

FOREIGN PATENT DOCUMENTS

| | | | |
|---|---|---|---|
| 94/24391 | 10/1994 | WIPO | 52/514 |

OTHER PUBLICATIONS

Adkins, J. D., Rapid Retrofit of Infrastructure Through Adhesive Bonding and Resistance Welding Abstract, 1993 Poster Book, Jul., 1993.

Finch, William W., Jr., et al., Bonded Composite Plate Reinforcement of Concrete Structures Abstract, 1993 University Industry Research Symposium, University of Delaware Sep. 29, 1993.

McConnell, Vicki P., Can Composites Rebuild America's Infrastructures, Advanced Composites, Nov., 1992.

*Primary Examiner*—Carl D. Friedman
*Assistant Examiner*—Laura A. Saladino
*Attorney, Agent, or Firm*—John C. Andrade

[57] ABSTRACT

This invention is an apparatus and process for the reinforcing of concrete, wood, or steel columns, beams, or structures. The apparatus includes pre-made reinforcing layers constructed of engineering materials having a high tensile strength and a high modulus that are attached, via an adhesive, or fitted to the element in question to create a reinforcing shell exoskeleton thus increasing the column's compressive, shear, bending, ductility, and/or seismic load carrying capacity.

44 Claims, 11 Drawing Sheets

COMPOSITE REINFORCED STRUCTURES

FIELD OF THE INVENTION

This invention relates to an improved method of reinforcing columns, beams, or structures (concrete, wood, or steel) with engineering materials having high tensile strength and high modulus preferably composite materials. It includes a method of reinforcing the columns, beams, or structures with an exoskeleton, made preferably of composite materials, a method of producing said reinforcing exoskeleton and the reinforced structure itself. This method offers the features of improved quality of the composite reinforcing members, reduced field installation equipment and time, lower chemical emissions in the field, and lower total system costs.

BACKGROUND

Concrete Structures

For years, concrete has been one of the most basic building materials used in the construction world. One of its most common uses is in a support role for highways, bridges, and buildings. In this role, it is usually found in the form of a column, with both a base that anchors it to the ground and a top that incorporates the deck of the structure that it supports, or in the form of a beam that is used to support a load and spans between columns or other supporting systems.

While concrete alone has fairly good compressive strength and structural characteristics, it became apparent to engineers and designers that a method of reinforcing the concrete was critical as the columns began to be designed for larger and larger loads. The chief means of reinforcing the concrete came from the other most common material in the construction world - steel. In various forms, steel was incorporated in the columns (internal reinforcement) to increase their tensile and bending load carrying capacity. If properly employed, the steel could greatly increase the strength and ductility of the column. The internal steel reinforcements appeared to be the answer. As time passed, however, it became apparent that there were many problems with the steel reinforced concrete columns.

First, the success of the reinforcing steel depends greatly on the proper execution of its installation. One of the main types of steel reinforcements is hoop steel, which is pieces of rebar or steel strap that are bent into hoops and welded or tied to the vertical rebar reinforcing members. When properly welded together and to the vertical members, the hoop steel substantially improves the column's ability to withstand dilation, tremors, and shocks associated with seismic disturbances. If the hoop steel is not properly welded, or attached to the vertical members, the transverse tensile loads from the seismic disturbances will cause the column to spall, which will lead to large chunks of concrete being dislodged from the column as the hoop steel is forced open. The failure of several major concrete columns in a concrete column supported interstate (I-880) in California during a recent earthquake showed that much of the hoop steel reinforcing members in the columns were not welded during installation. Contractor documentation revealed that these poor installation practices were a common occurrence in California and other states (pre-1975), thus thousands of in-use concrete column supported structures are deficient in their load carrying capacities and seismic performance.

It has also been shown that under typical column or beam stress states, the poor tensile strength of concrete initiates failures at the surface of the column or beam.

A second major problem involves the inherent nature of steel and concrete, they are both readily susceptible to corrosive elements such as water and their environment (acid rain, road salts, chemicals, oxygen, etc.). Concrete shows the effects of environmental attack by pitting, and spalling, which leads to severe cracking and a marked reduction in strength. Steel not only succumbs to chemical attack (rust), but during the process undergoes a physical transformation in size (increases). Rusting reinforcing steel in concrete columns expands to the point that the internally created stresses are so large that they crack the concrete to such an extent that often large pieces of concrete are displaced from the column. The net result is a dramatically weaker structure.

Steel Construction

Steel is not only used by the construction world as a reinforcing agent but also as a primary building agent. But this fact does not change the way steel reacts to the environment. Steel is very susceptible to environmental attack and great measures must be taken, in the form of paints and surface treatments and alloys, in order to prolong the life of the steel.

There are thousands of in use steel structures that are poorly maintained and in need of rehabilitation. Many of these structures have deteriorated to the point that welding on new steel to reinforce the structure would add so much weight that the structure would collapse. Wood Structures Much like concrete and steel, wood structures also fall prey to the environment. This takes place in the form of rot. As wood rots, its structural integrity is reduced resulting in a dramatically weaker structure. While wood is not commonly used in large structures such as (new) bridges and highway overpasses, it remains a primary building material, especially in and around marine environments and in small rural bridges. Similar to steel, there are many wooden structures that are poorly maintained and in need of rehabilitation. In addition to bridge structures, telephone poles represent a very large use of a wood structure as a load bearing element. Every year, thousands of poles need to be replaced due to rot, especially near or below the ground. Instead of replacement, these structures could be repaired using the appropriate jacking technique.

In and around tidal zones, environmental attack is much more apparent. In particular, concrete, wood, and steel support columns, beams, and structures that are in a marine environment (such as docks, offshore platforms, etc.) exhibit dramatically shorter life times as they fall prey to corrosion, tidal erosion, and marine bore attack. Support columns in a relatively close proximity to these marine areas also exhibit a reduced life span as the effects of the corrosive environment spread.

In an era of expanding population, increased highway travel, constant earthquake threats, increased shipping vehicle loads, and continuing environmental decay, now more than ever, there exists a need to rehabilitate these structures in a fast, inexpensive, safe, and environmentally clean way that will last well into the future. The key to the successful rehabilitation of these structures will be to minimize the disruption of the activities that occur over and around the structures. Simply, this means not shutting down traffic lanes as bridge support columns are retrofitted, piers as pilings are retrofitted, etc. The ability to fix in place will be instrumental in the success of these programs.

As the idea of an external reinforcement for support columns gained acceptance, the first attempts used steel jackets as a reinforcing means. These jackets consisted of large pieces of steel plate that were rolled to the diameter of the column in question. A crane was then used to position the pieces around the column and the pieces were butt welded together. This solution had many problems, the most important being the weight of the pieces. The plate had to be fairly thick so that a good weld could be achieved and so that the pieces would not bend and kink as they were being lifted from the truck on which they were transported. The welded butt joint gave no tolerance to the column, thus requiring the additional step of grouting between the jacket and column to accommodate typical field tolerances. This heavy weight necessitated the use of heavy equipment to both transport and install the pieces. The large equipment led to many problems as multiple traffic lanes on the interstates had to be closed in order to install the plates. The weight of the plates also posed a safety issue for the workers.

Based on the critical jacket thickness for welding and the characteristic material properties of steel, these jackets were actually too stiff for their intended purpose. The now stiffened column structure would actually attract additional load during a seismic disturbance and change the designed fundamental natural frequency of the structure, thus creating new structural problems and increasing the likelihood of failure. Another problem came again from the nature of steel, as it corrodes very easily. Although steel itself is inexpensive, the above mentioned structural, application, and maintenance problems all contributed to a high system cost.

As the knowledge base and use of composite materials increased, it became apparent that composite materials offered a potential solution to the decaying or poorly constructed concrete column problem and the problems associated with the steel reinforcing jackets. These materials could offer dramatic increases in strength and are impervious to the environmental attack that destroys the steel and concrete. Additionally, the tailorability of the composite allows for the application of strength in specific (fiber) directions with or without the introduction of stiffness, depending on the desired affect.

U.S. Pat. No. 4,786,341 describes a process of wrapping a concrete column with a resin impregnated fiber. Essentially, this is filament winding around an existing structure in the field. While the final composite encasing is of adequate strength, the process is excessively time consuming, prohibitively costly, produces a composite with a high percentage of voids (3%–5%), and exposes large amounts of chemical byproducts of the resin to the workers and the environment. Additionally, applying the reinforcement near the column ends is very difficult. In this case, field conditions will heavily influence the composite quality and its associated material properties.

U.S. Pat. No. 5,043,033 describes a process of wrapping a concrete column with a fiber tape, encasing the outside with a resinous substance to create a shell, and injecting the gap between the concrete and the fibers with a hardenable liquid. While the final composite encasing is of adequate strength, the composite is susceptible to air entrapment, and the process is excessively time consuming, and prohibitively costly, especially including the fluid injection (pressure grouting) step. Again, field conditions will greatly influence the final material properties.

U.S. Pat. No. 5,218,810 describes a process where a fibrous preform of considerable width is pre-impregnated with a resin and wrapped around the concrete column to form a composite reinforcement. While this process theoretically showed an improvement in time versus the two previously cited patents, it still did not solve many problems. Although the actual wrapping time was theoretically reduced, the necessary equipment set-up and removal times were still very long as was the time to adequately impregnate the fibers with resin, thus rendering the process prohibitively costly. Field tests showed that handling the 'wet-preg' was very difficult, especially under windy and dirty conditions. Additionally, the composite was of an inferior quality (5%–10% voids typical in this type of lay-up process) and there was still an unreasonable exposure of the environment and the workers to chemical byproducts of the impregnating resin process.

The previously mentioned methods all suffer from multiple problems. In all cases, the excessive time requirements for equipment set-up, removal, and the actual wrapping time for the process led to costs that were excessive. The final quality of the composite members is also brought into question. Each method is extremely susceptible to air entrapment, incomplete fiber wetting, and contamination during the handling and subsequent lay-up of the impregnated fibrous preform. The air and debris entrapment experienced during field installation causes voids that substantially weaken the reinforcing capabilities of the composite material. Constantly varying field temperatures influence the fundamental chemistry of the impregnating resin, again leading to wide variations in the final retrofit system quality. Finally, making the composite on the target structure leaves no room for error. If problems occur during installation, the costly process of removing the composite from the column must be undertaken and the entire process must be repeated.

In the case of 'wet-preg' in wet lamination, compaction forces must be applied via a vacuum bag before any of the reinforcing layers begin to cure or gel. Time constraints of the wet process, gravity effects of a "total thickness, ungelled system", and typical bag leaks on cracked concrete make 'wet bagging' in the field a completely unmanageable task.

It is the objective of this patent to provide an improved process for the reinforcement of concrete, wood, and steel columns, beams, and structures preferably with composite materials that is fast, inexpensive, predictable, repeatable, environmentally sound, and accommodating to typical field tolerances.

It is an additional objective of this patent to provide a reinforcement apparatus of composite materials of superior quality, versus other composite articles.

It is a further additional objective of this patent to provide an improved means of manufacturing said composite materials.

These and other objectives of the invention will be apparent to those skilled in this art from the detailed description of a preferred embodiment of the invention.

SUMMARY OF THE INVENTION

The reinforced load supporting structure of the present invention has an inner load supporting structure typically a column, beam, or other support structure made of concrete, wood, or steel. The exposed perimeter of the inner load supporting structure is enclosed by a layer of at least one distinct piece of preformed engineering material having high tensile strength and high modulus preferably a pre-cured composite. Additional layers can be added as described in the process below.

Engineering materials are materials that have been historically used in the design and construction of engineered structures. Examples would include, inter alia, steel, aluminum, plastic, composite materials, other metals, wood and concrete. Engineered materials having high tensile strength and high modulus would be effective in the exoskeleton used to reinforce the load supporting structure of the present invention.

An adhesive substance adheres the layers to each other and preferably to the inner load supporting structure. A means for separating the first layer from the exposed perimeter of the inner load supporting structure can also be utilized where warranted. Such separating means would preferably include a barrier such as a release film which can be wrapped around the exposed perimeter of the inner load supporting structure or stations creating a skeleton and grouting the space between the first layer and the structure and the first layer could be adhered to the barrier.

The term "pre-cured" in reference to the composite reinforcing layers, refer to composites, made in a manufacturing facility, that are added to the column, beam, or structure in a final or cured state, as opposed to adding wet fibers and resin that must then undergo a curing stage at the field site.

After it is determined that the structure in question, e.g. a concrete column requires reinforcing, the engineering material is preformed to the required geometry, then the preformed pieces are bonded or fitted onto the concrete column to create a reinforcing shell (exoskeleton). The actual installation process for the preformed pieces is as follows. After determining the desired number of layers, the layer pieces are arranged near the column to be reinforced. The inside of the pieces may have a coating of adhesive applied to them and then they are lifted and placed onto the column. It should be noted that, no matter what arc size is picked for the composite, the actual pieces are preferably undersized so that the butt joints within the plane of the individual layers do not touch (i.e. less than 360° total arc length), to allow for a tight, custom fit during the pressure application stage. After the first layer is in place, a second layer is attached to the column in such a manner that the joints or seams do not align or overlap. The first piece of the second layer can be rotated, and attached over the first layer to eliminate any vertical seam overlap. As more segments become necessary, the butt joint seams are continually rotated to maximize the lap shear area and eliminate any vertical seam overlap. If more than one piece is needed to span the height, a similar stepped lap technique is used to evenly distribute the butt joints across several horizontal planes so that the joints do not align or overlap. Additional layers can be added to overlap the joints for an added safety factor. The same process is repeated until the desired number of layers are installed.

Upon installation of the final layer, the adhesive is cured, preferably by exerting pressure on the outside of the column to ensure a tight fit of the layers and to help drive any trapped air out of the adhesive layers. The pressure can be exerted by means such as ropes, bands, a vacuum bag, or straps and clamps, where the straps are tightened, preferably, from the base of the column to the top of the column, to facilitate vertical flow of adhesive, eliminating trapped air. The pressure also causes the adhesive on the inner most layer to act like grout as it is forced into any cavity or crack on the surface of the item being reinforced.

The terms "adhesive" refers to any substance of sufficient physical characteristics such that it can easily be applied to the interior surface of the pieces of engineering material and, upon placing the composite pieces onto the element and allowing the adhesive to dry or cure, provides ample strength to attach the composite pieces to both the element being reinforced and/or each other. Examples of such substances include, but are not limited to, traditional glues, resins, resins enhanced with fillers, etc.. As noted above, in some cases direct adhesion to the structure being reinforced is not desirable.

The previous description involved a round column as the item to be reinforced. Examples of round columns that could be reinforced by the present invention are concrete overpass supports, steel refinery chimneys or stacks and wooden marine pilings or telephone poles. One of the advantages of this invention is that it also allows the same procedure to be used on a variety of cross sectional geometries and field application sites. Other applications would be for square sections, T sections, I-beam sections, and oval cross sections in a wide variety of field sites such as columns, main support beams, bridge deck beams, and shear beams. In all cases, it is desirable to form a complete exoskeleton around the structure to be retrofitted. Field conditions may make this difficult or impossible. This invention allows for the simple application of engineering materials to all exposed surface areas. Because the engineering materials are preformed, standard cut and fit techniques can be used to easily circumvent typical field obstacles.

A second method to apply the adhesive to the structures uses a vacuum assisted technique to install the layers onto the concrete column. Instead of applying the adhesive to the inside of the pieces prior to their being placed on the column, they are left dry and placed onto the column in the same fashion and pattern as if they had adhesive on them. The column and layers are then wrapped and marginally sealed via a means such as a vacuum bag. Through the bag is placed an inlet or inlets through which an adhesive can be introduced and an outlet or outlets through which a vacuum can be applied to the system. After applying the vacuum and evacuating the system, the adhesive is introduced under normal atmospheric pressure (with the vacuum as the driving force) or under mechanically enhanced pressure. The adhesive will then travel between the concrete column and the first layer and between the gaps between all of the other layers. The vacuum is left on until the adhesive cures and then the entire bag assembly is removed and the finished reinforced column or structure is left.

Production of Reinforcing Layers

The general premise of the composite manufacturing scheme is to produce high quality composite layers, consisting of one or more laminates, to the near geometric shape of the item to be reinforced. All commercial composite manufacturing techniques are viable for this purpose (i.e. hand lay-up, RTM, prepreg, pultrusion, compression molding, filament winding, etc).

Any commercial composite manufacturing technique can be used to produce the composite reinforcing layers. However the manufacturing process of the present invention is particularly well suited to fabricating the composite pieces necessary to reinforce the reinforced load supporting structure of the present invention.

The process starts with a tool, either male or female, whose shape is similar or equal to the target structure's to be rehabilitated. In the case of a circular column, the radius is approximately equal to the radius of the column in question. A desired fibrous preform, that would define a layer of the shell, is placed on or in the tool. The actual layer may consist of either a single or a plurality of fibrous plies with a constant or varying thickness. The plies may consist of a single material or a mixture of reinforcing materials made from tapes, fabrics, or mats constructed from all commercial composite fibers (i.e. glass, carbon, aramids, steel, ceramic, UHMW polyethylene, etc).

Upon completion of the first layer of the lay-up (one or more laminates), a piece of porous release ply is placed over the layer and a second layer is then layed-up over the release film. This process is repeated until the desired number of layers for the composite shell are layed-up. The lay-up is then impregnated with a resin system and allowed to cure to form the composite layers. Upon demolding of the part, the individual layers peel apart much like an onion's skin. This process allows for the production of numerous layers in a single molding step.

The term "resin" refers to any substance, or combination of substances, of a suitable viscosity such that they can be used to impregnate the fibrous preform in question and ultimately undergo a physical state transformation from a low viscosity fluid, to a rigid or semi-rigid solid (where said transformation can occur via various means such as chemical reactions, a thermal cycle, etc.) and act as a binding matrix for the fibrous preform to create a final composite material. Examples of such substances include, but are not limited to, vinyl esters, polyesters, urethanes, BMIs, phenolics, acrylics, epoxies, cynate esters, and thermoplastics.

It should be noted that the preferred resin impregnating technique in this description is SCRIMP as set out in U.S. Pat. No. 4,902,215. The 'onion skin' approach is preferred due to its ability to accommodate the radius changes derived from the layer to layer application (build-up) of the composite. However, because each composite layer is thin and flexible, a single part geometry derived from a single tool can be used with standard molding practices. Subsequently, individual composite layers can be 'flexed' into place and strapped or vacuumed onto the structure being retrofitted. This single layer, single mold technique is acceptable, but is not as efficient as the 'onion skin' approach.

DESCRIPTION OF THE PREFERRED EMBODIMENT

Figure 1:
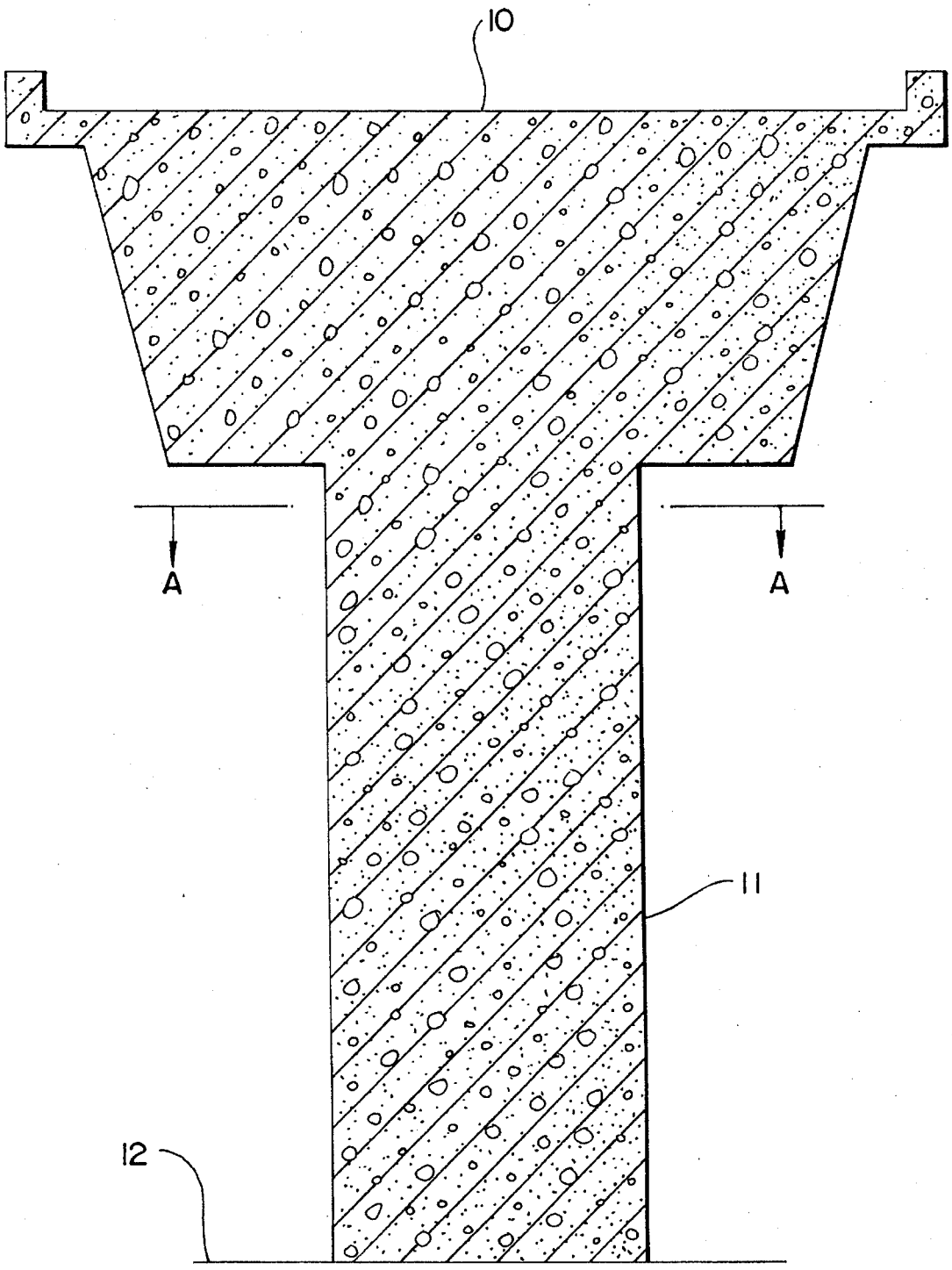
FIG. 1 is a cross sectional view of a typical concrete support column with an overhead roadway.
Figure 2A:
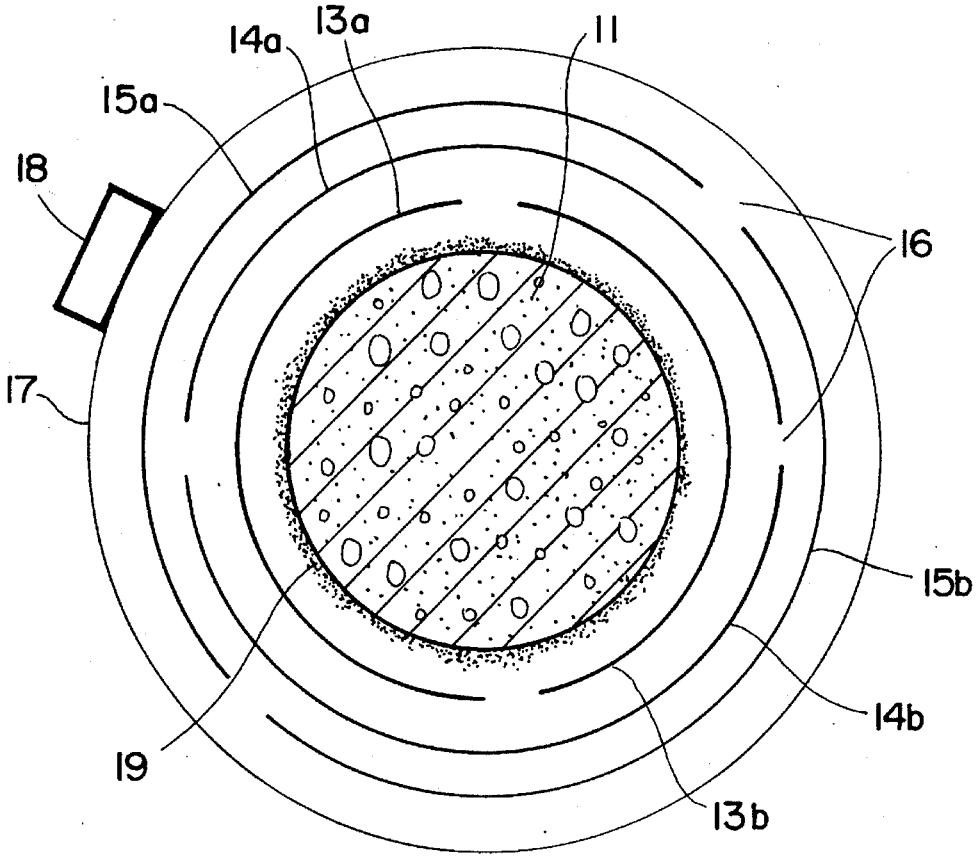
FIG. 2*a* is a cross sectional view of FIG. 1 taken through line A—A, with the addition of a reinforcing shell that consists of three layers of composite material.

Referring first to FIG. 1, there is shown a typical support column 11 which would typically be constructed of concrete, wood, or steel. On top of the column is a roadway 10 and the column is attached to a base 12, which typically would be a concrete slab or the ground. FIG. 2*a* shows a cross sectional view of FIG. 1 through line A—A. There are three layers of pre-cured composite material, each composed of two composite pieces, a first layer, having arc-shaped composite pieces 13*a* and 13*b*, a second layer, having composite pieces 14*a* and 1419, and a third layer, having composite pieces 15*a* and 15*b*, that create the reinforcing shell. The layers can be a single or a plurality of pieces of engineering materials having a high tensile strength and a high modulus whose addition to the column serves to enclose the exposed perimeter preferably for the height and circumference of the column. The preferred engineering material is composites and individual layers can be composed of one or more composite pieces made from tapes, tows, fabrics, or chopped composite fibers and impregnated with typical composite thermosetting or thermoplastic resins. The exoskeleton can cover the exposed perimeter of the column beam or other structure partially or for the entire height or length of the structure.

Figure 2B:
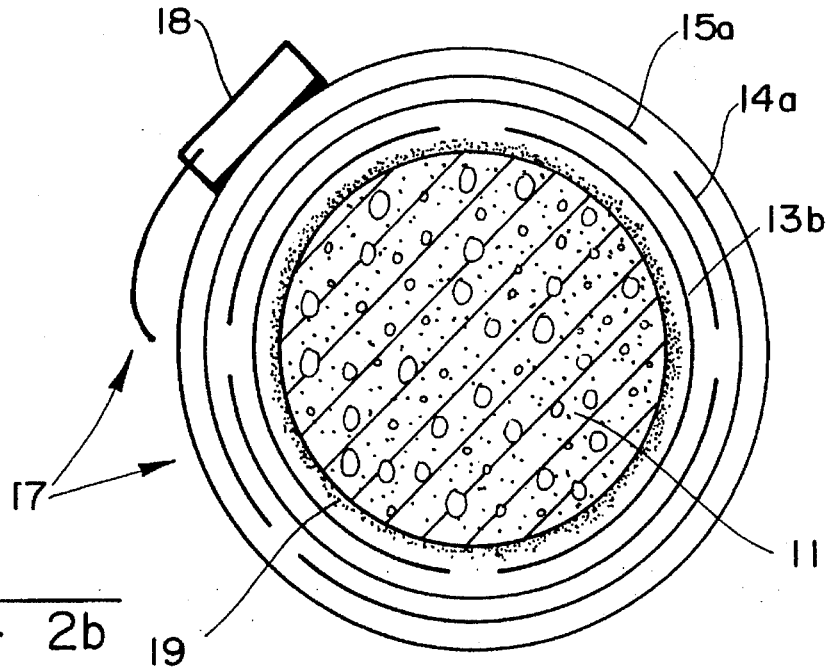
FIG. 2*b* is a cross sectional view of FIG. 1 taken through line A—A, with the addition of the same reinforcing shell as shown in FIG. 2*a* after pressure has been exerted on the three layers of composite material.

The orientation of the layers in FIG. 2*a* is typical and not an exclusive representation of this invention. The adhesive 19 is shown between the column 11 and the first layer 13*a* and 13*b*. The adhesive would also be applied between the layers (not shown). The joints 16 between the composite pieces in the same layer are wide enough such that the edges don't meet, even when pressure is applied to the layers. The pressure can be applied via means such as a strap 17 and a mechanical clamp 18. In FIG. 2*a* the strap 17 has not yet been tightened. In FIG. 2*b* the strap 17 has been tightened to exert pressure on the layers.

Figure 3:
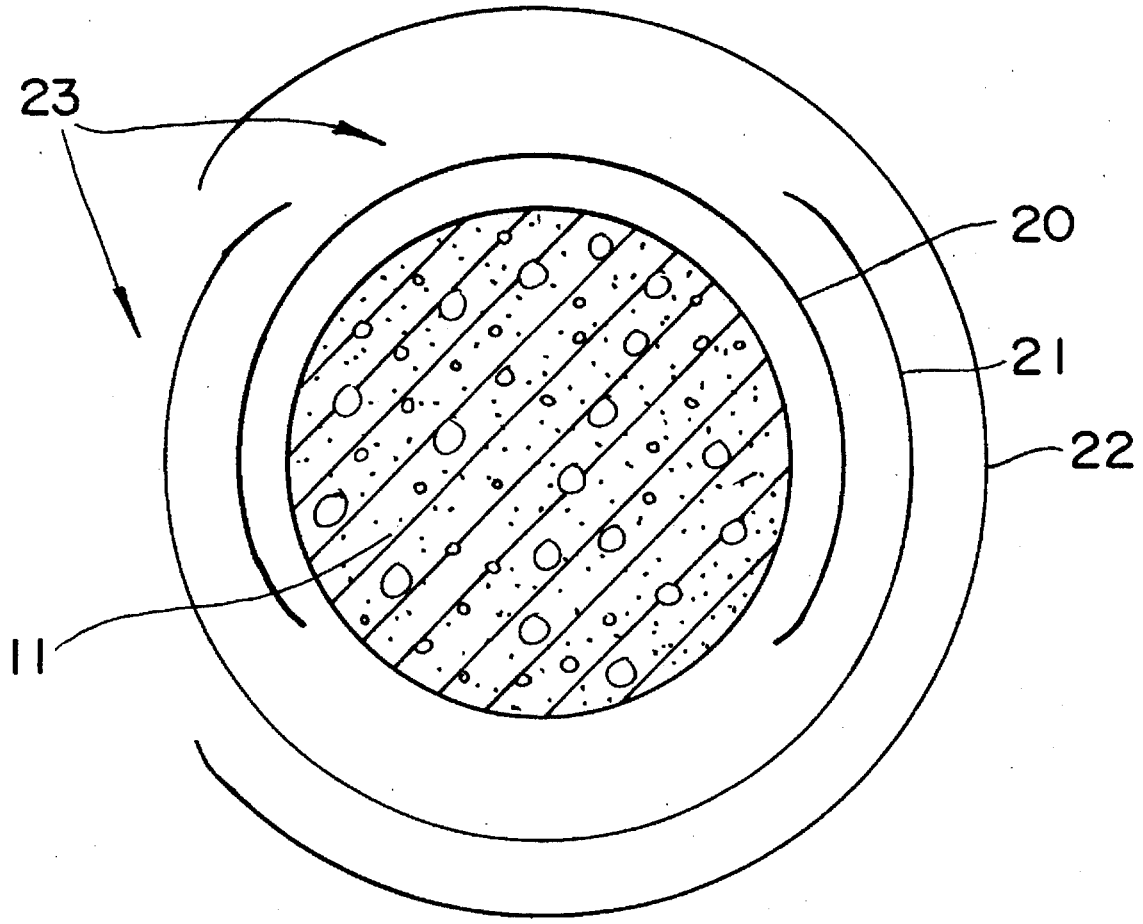
FIG. 3 is the same cross sectional view of FIG. 1 taken through line A—A with the addition of a reinforcing shell that consists of three layers of composite material, whose layer pieces extend beyond one-half of the column's circumference.

FIG. 3 shows a cross sectional view of FIG. 1 through line A—A, but with a different composition of the layers in the reinforcing shell. There are three layers of pieces, a first layer 20, a second layer 21, and a third layer 22 that create the reinforcing shell, however their circumferential length is much greater than for the pieces shown in FIG. 2*a* and 2*b*. There is only one joint 23 per layer in the reinforcing shell shown in FIG. 3.

Figure 4:
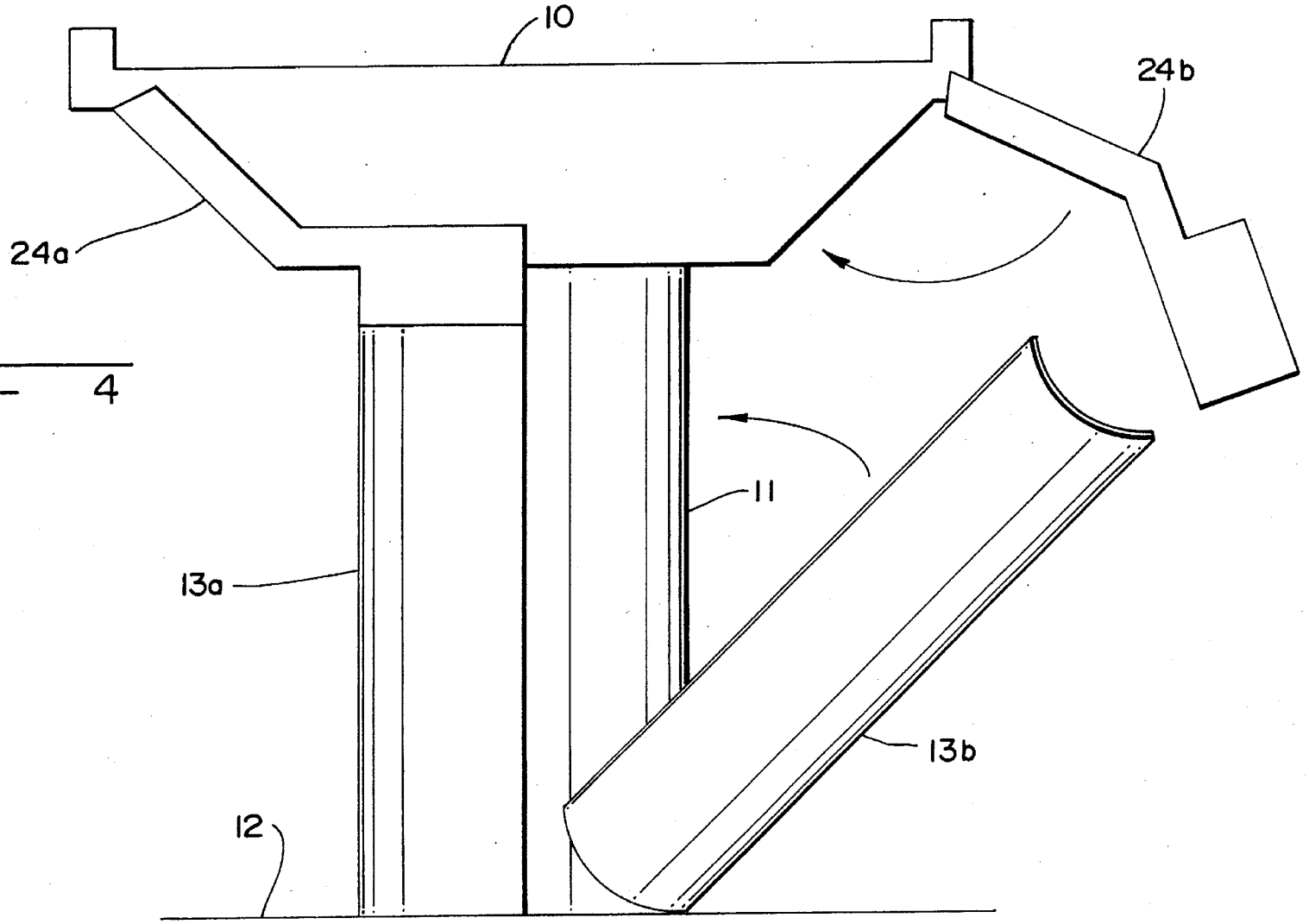
FIG. 4 is a perspective view of a field assembly of a composite reinforcing shell with one half of the first layer in place and the second half being erected and a column/beam intersection being reinforced.

FIG. 4 shows a typical field assembly of the composite reinforcing layers shown in FIGS. 2*a* and 2*b*. The first half of the first layer 13*a* is in place on the column 11 and the second half of the first layer 13*b* is shown being erected. In this figure, the first layer consists of both a cylindrical section 13*a* that encompasses the body of the column and a cylindrical to rectangular section 24*a* that reinforces the joint detail between the overhead deck assembly 10 and the top of the column 11. The first half of the cylindrical to rectangular laminate 24*a* is shown in place on column 11 and the second half of the first layer 24*b* is shown being erected.

Figure 5:
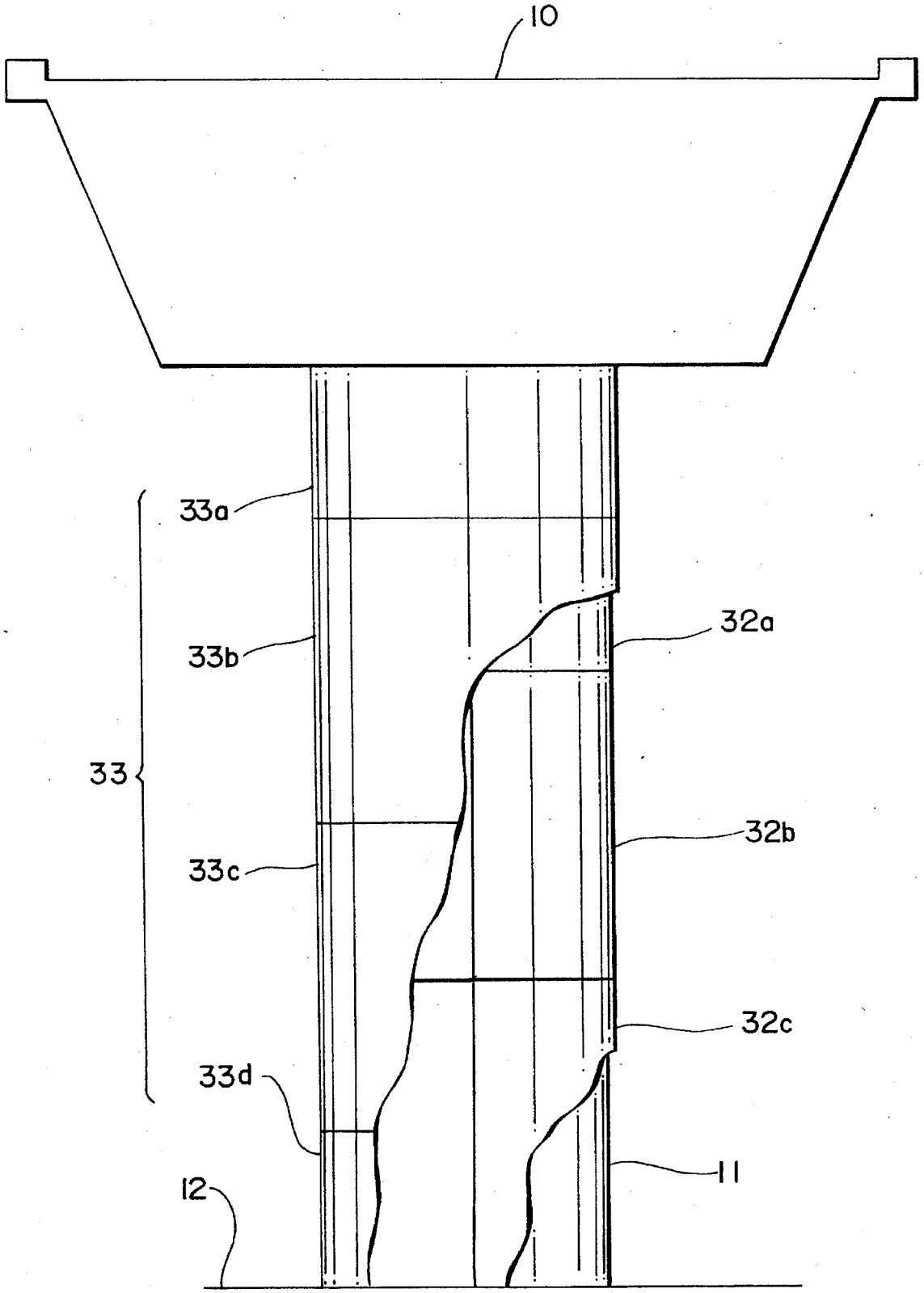
FIG. 5 is a perspective view of an installation of multiple layers with a horizontal lap shear joint when the column is too tall to span its height with a single piece.

FIG. 5 shows a typical installation pattern on a column 11 whose height is too great to span with a single piece. In this case, three segments are needed to span the height. Upon installation of the first layer 32*a, b,* and *c,* the second layer 33*a, b, c,* and *d* is installed in such a way that no horizontal seams overlap. Particularly in this example, the position of the second layer pieces 33 versus the first layer pieces 32 is a rotation of 90 degrees around the circumference of the concrete column 11 and a change in height of one half of a layer segment height. This assembly prevents seam overlap that would weaken the reinforcing shell. An over design of the required lap shear area is utilized to ensure that the horizontal joint of the exoskeleton is not a weak link in the system.

Figure 6:
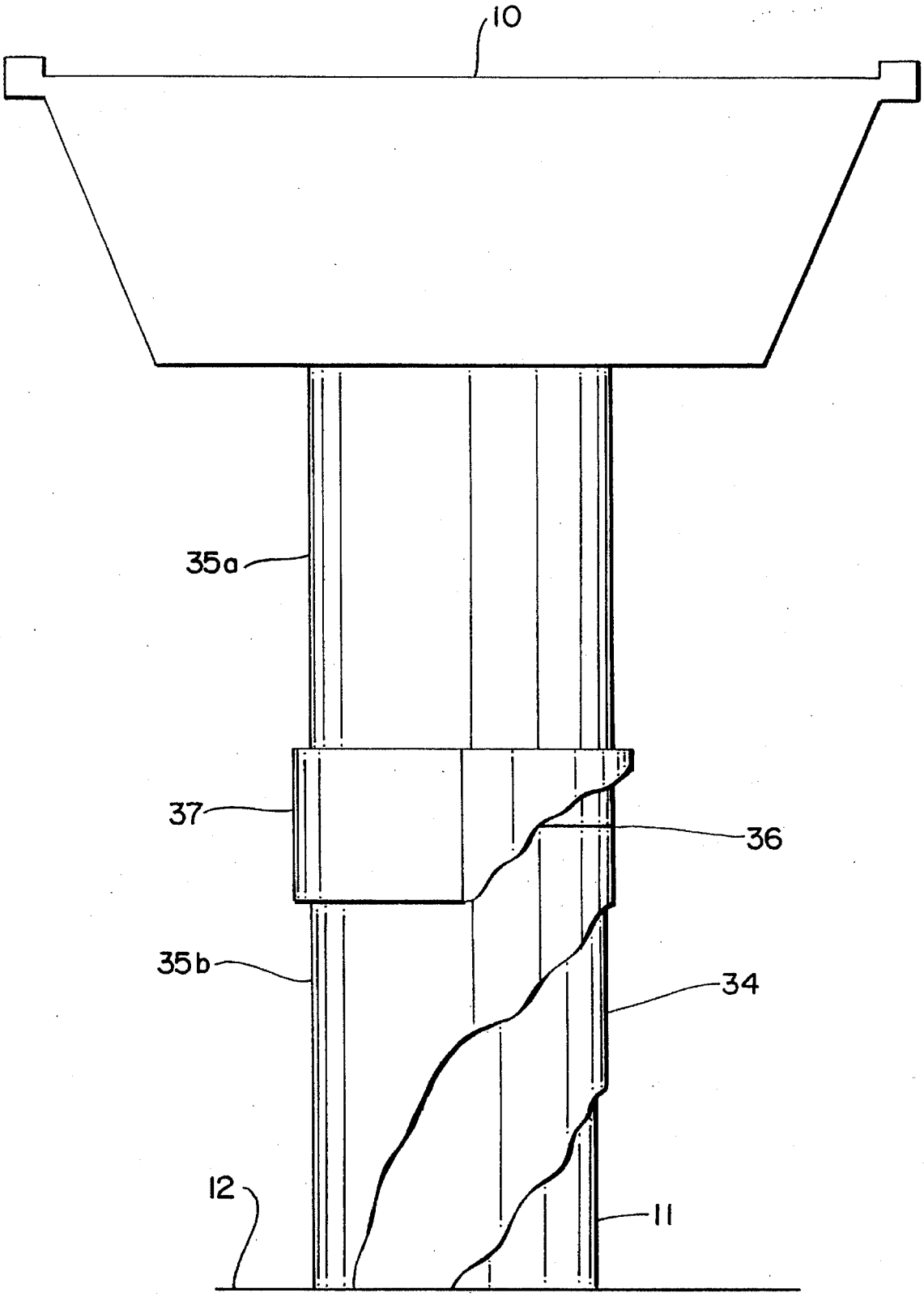
FIG. 6 is a perspective view of another installation of multiple layers when the column is too tall to span its height with a single piece, that utilizes a collar for an additional safety factor.
Figure 7:
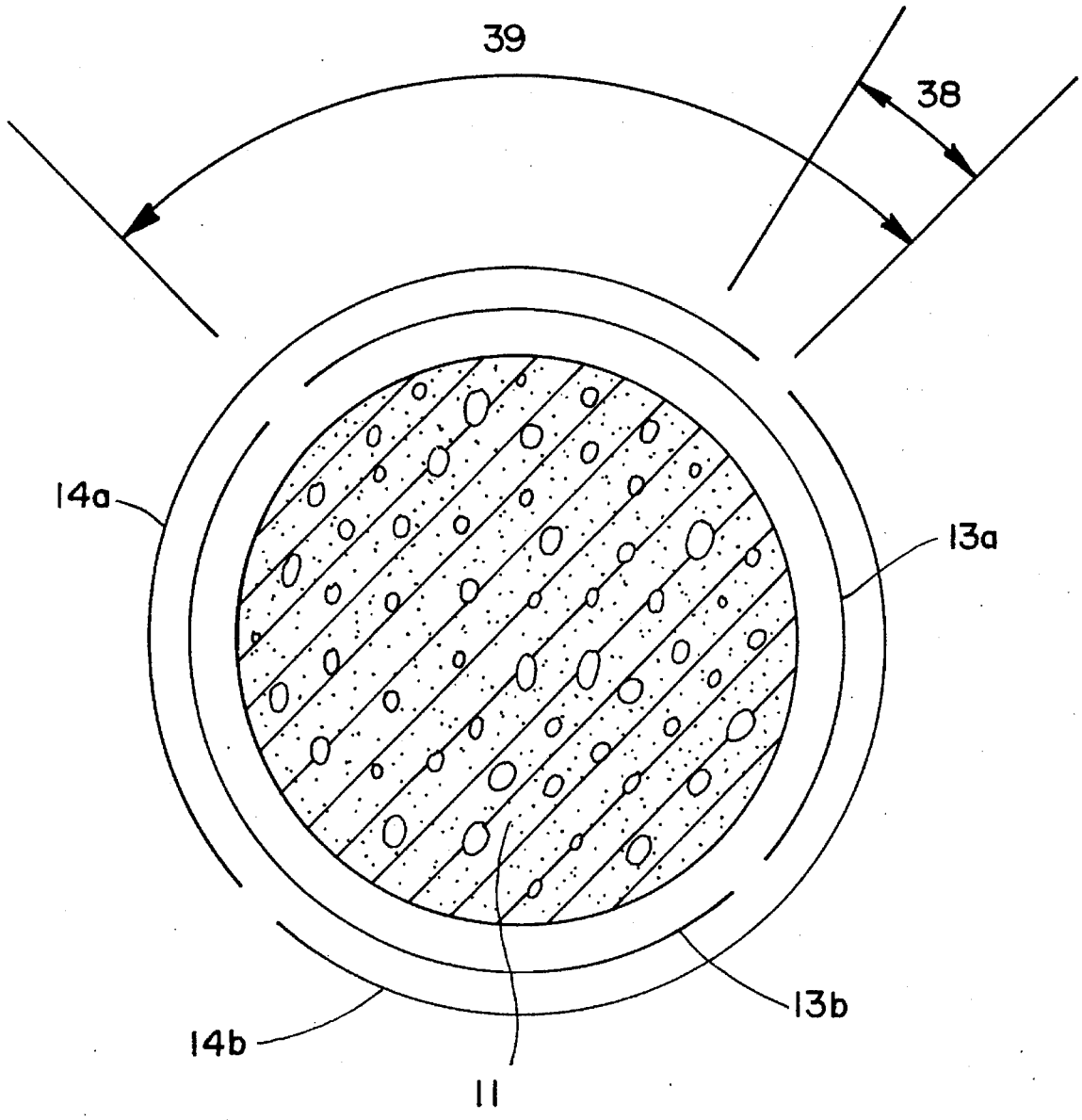
FIG. 7 is a cross sectional view of a required lap joint length and the actual lap joint length achieved during installation on a six inch (6") diameter column.

FIG. 6 shows another typical installation pattern on a column whose height is to great to span with a single piece. In this case, two segments are needed to span the height. Upon installation of the first layer 34, the second layer 35*a* and *b* is installed in such a way that no vertical seams overlap, but a horizontal seam 36 is created between the top 35*a* and bottom 35*b* pieces of the layer. Over this seam is placed an additional plurality of layers in such a manner that a collar 37 is created and the seam is effectively covered to increase the horizontal seam safety factor. The positioning of the composite layer pieces in FIGS. 5 and 6 is a typical representation of a situation where a single layer piece is not practical to span the height and arc length of the concrete column. Variations in the number of pieces used to span the height of the concrete column or the positioning of the layers in relation to one another is covered by the spirit and scope of this invention. FIG. 7 shows the critical lap joint length 38 and the actual lap joint length 39 achieved during the installation shown in FIGS. 2*a* and 2*b*.

Figure 8A:
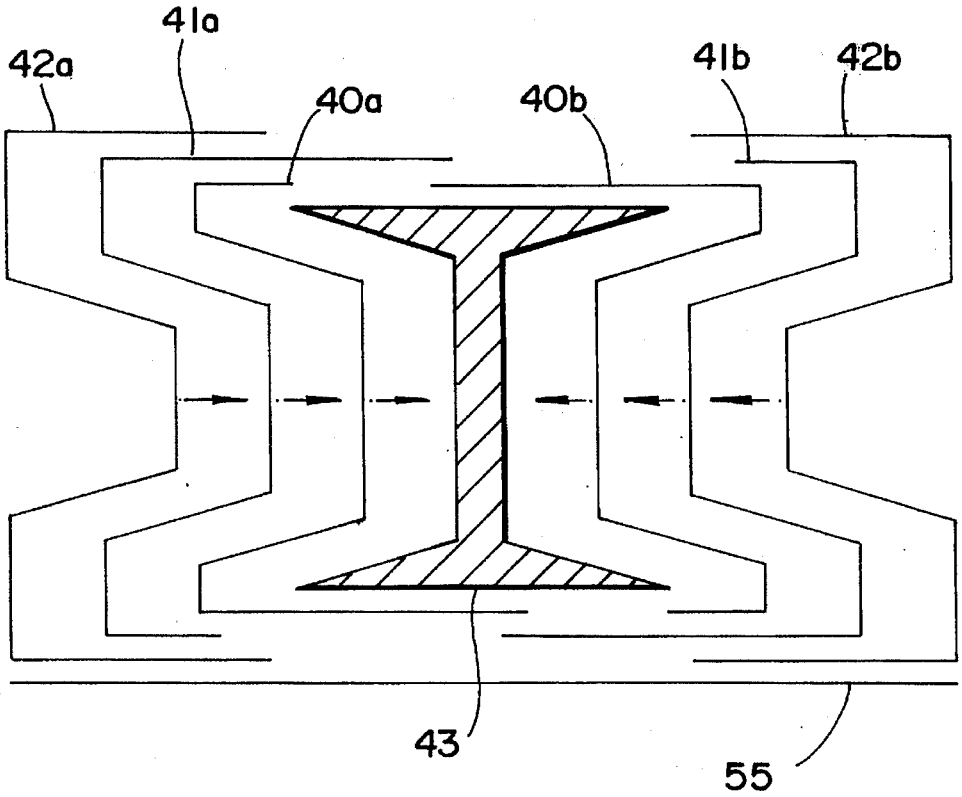
FIG. 8*a* is a cross sectional view of an I-beam support structure.
Figure 8B:
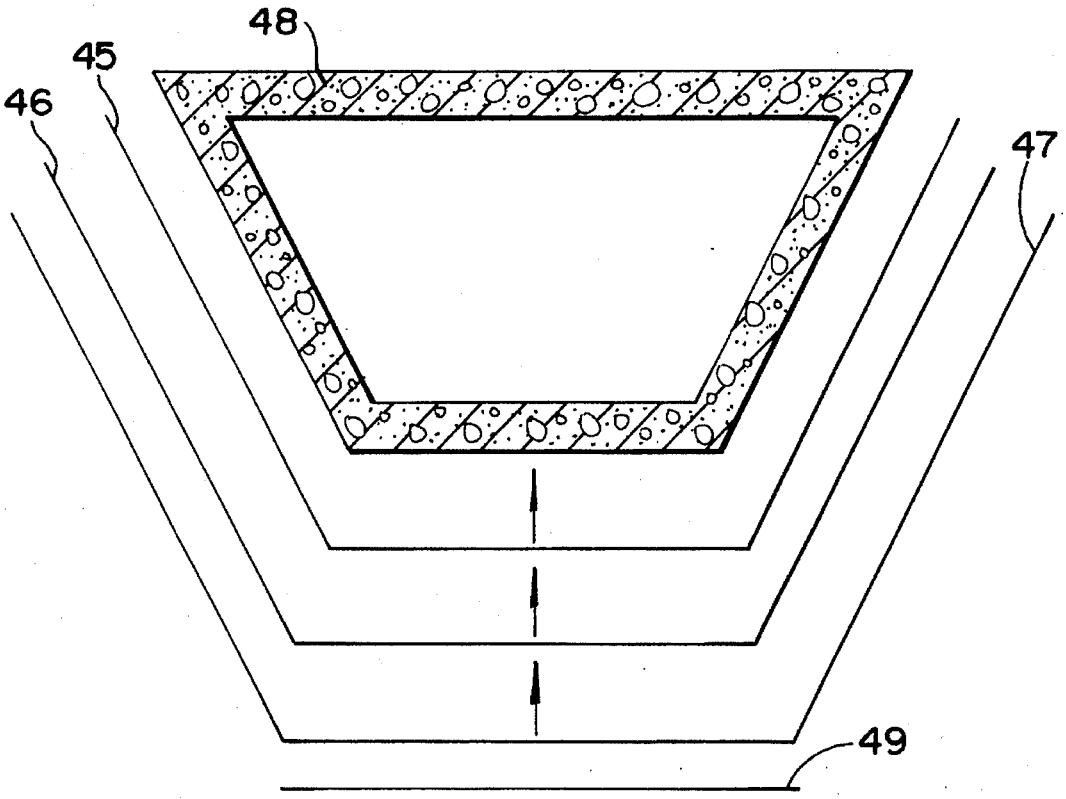
FIG. 8*b* is a cross sectional view of a box beam support structure.
Figure 9:
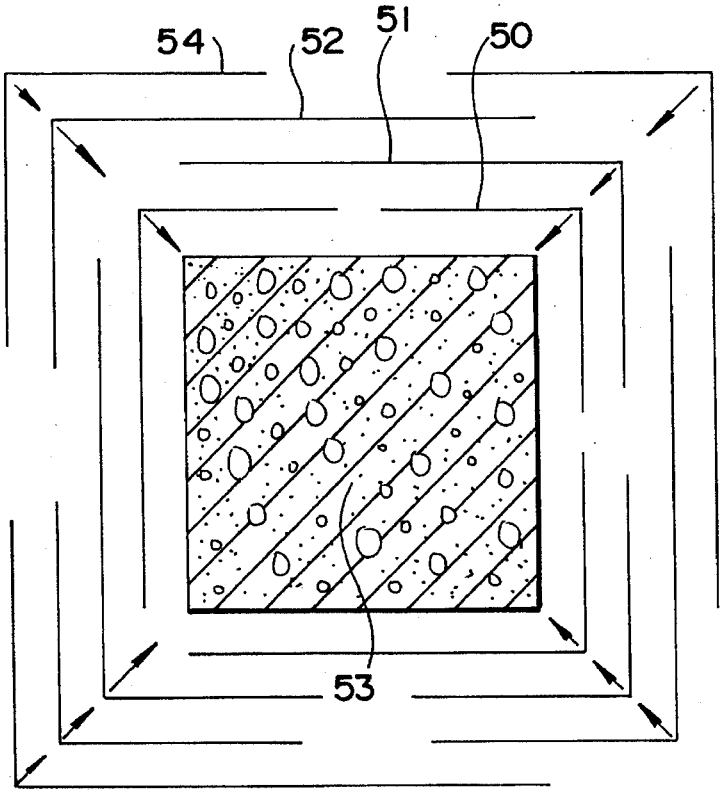
FIG. 9 is a cross sectional view of a square support structure.

FIGS. 8*a* and 8*b* show typical cross sectional views of support structures that often require reinforcing. The structures represented here are a typical I-beam 43 and a typical box beam 48. In each case, three layers, each constructed from one or more pieces of engineering material (40*a* and *b*, 41*a* and *b* and 42*a* and *b* in FIG. 8*a* and 45, 46, 47 in FIG. 8*b*) along with an additional reinforcing piece (55 in FIG. 8*a* and 49 in FIG. 8*b*) create the final reinforcing shell. FIG. 9 shows yet another typical cross sectional view of a support structure. The structure represented here is a square column 53 that is being retrofitted with four layers of angular shaped engineering pieces 50, 51, 52, and 54. In FIGS. 8*a* and 9 the entire perimeter of the I-beam and the square column are exposed and thus the entire perimeter of the structure is enclosed, preferably for the entire length of the structure. In FIG. 8*b*, only three sides of the box beam are exposed and thus only three sides are enclosed by the layers of engineering material.

Figure 10A:
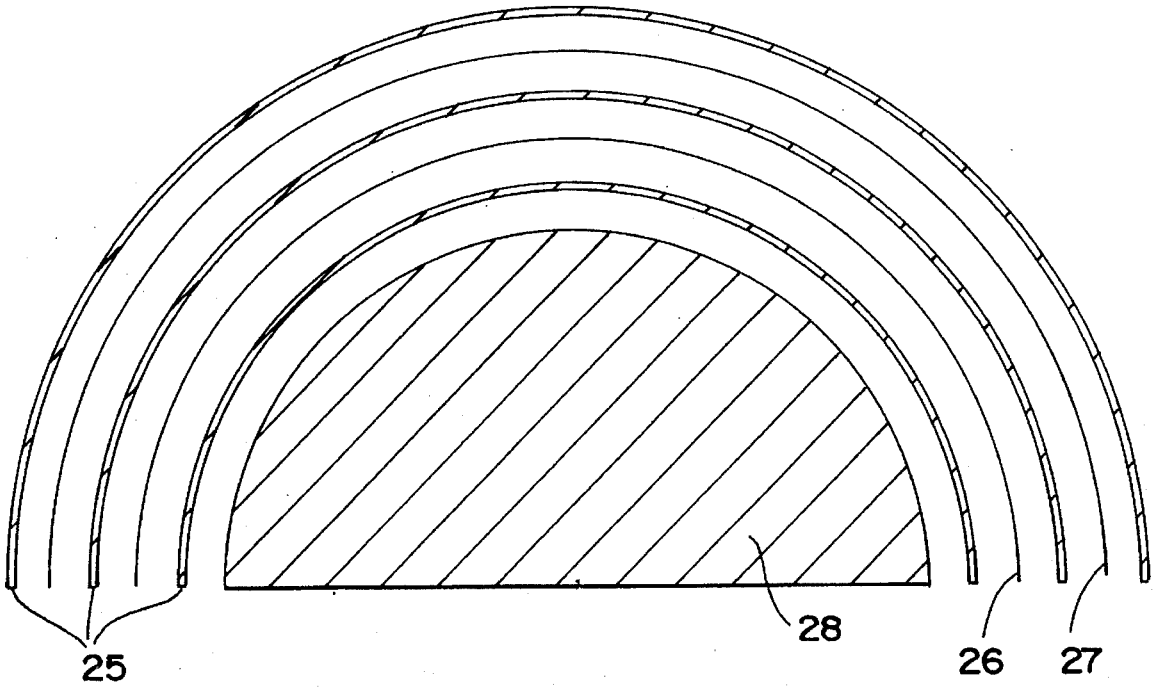
FIG. 10*a* is a cross sectional view of a three layer lay-up on a male tool.
Figure 10B:
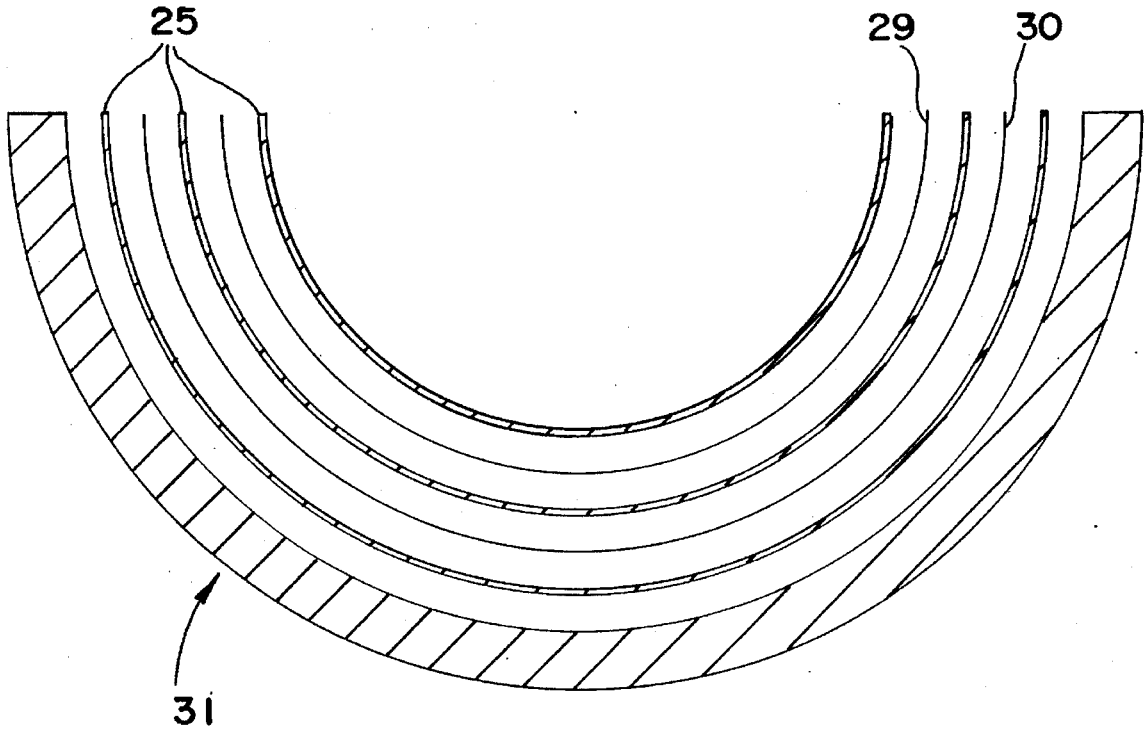
FIG. 10*b* is a cross sectional view of a three layer lay-up on a female tool.

FIG. 10*a* shows a typical lay-up apparatus for the manufacture of multiple composite pieces in a single step, with three layers (each layer consisting of one or more pieces) of fibrous preform 25, each separated by a layer of porous release material 26, 27 draped over each layer of fibrous preform 25 on a male tool 28. FIG. 10*b* shows typical lay-up apparatus for the manufacture of multiple composite pieces in a single step, with three layers (each layer consisting of one or more pieces) of fibrous preform 25, each separated by a layer of release material 29, 30, draped over each layer of fibrous preform on a female tool 31.

Figure 11:
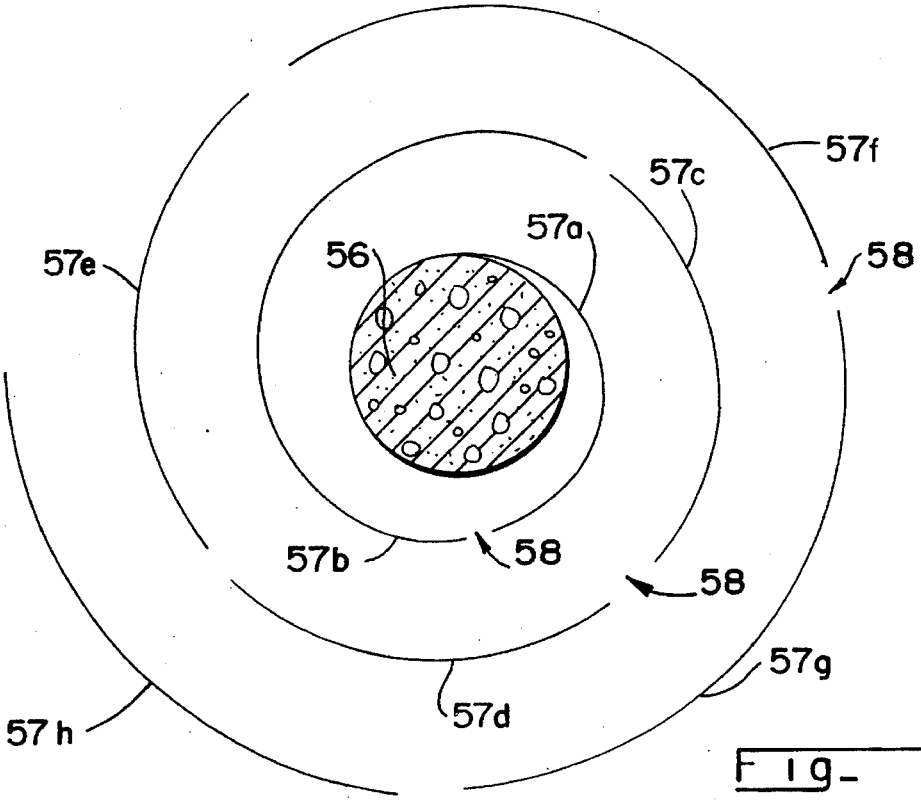
FIG. 11 is a cross sectional view of a typical concrete support column showing the process of the addition of a reinforcing shell that consists of three layers of reinforcing shell wherein the composite pieces are added adjacent to each other.

Another method for reinforcing a load supporting structure is shown in FIG. 11, where a round concrete column 56 is reinforced with two to three layers of engineering materials having high tensile strength and high modulus. The first piece 57*a* is placed around the column as shown and then adhered thereto(adhesive not shown). The second piece 57*b* is placed next to the first piece separated by the joint 58 and adhered to the column and as shown overlaps the first layer 57*a*. The third piece 57*c* is sized and placed, adjacent to the second piece 57*b*, so that the joint 58 between the third piece 57*c* ; and the fourth piece 57*d* is not aligned with the joint between the first and second piece 57*a* and 57*b*. The fifth piece 57*e*, sixth piece 57*f*, seventh piece 57*g*, and eigth piece 57*h* are sized and placed so that the joints between each piece are not aligned with the joints on the next inner level.

In some cases the column or structure geometry needs to be changed during the retrofit procedure to accommodate additional static or seismic load. In most cases the structure being retrofitted will remain in use during the retrofit. As a specific example, some square columns can be retrofitted with larger diameter oval jackets and subsequently grouted to leave a larger fully jacketed system, which after the retrofit are capable of sustaining greatly increased loads. In this case it is desirable to create the jacket made from bonded layers, offset a distance from the square column to redefine an oval geometry into which grout can be poured to ensure load transfer from the original column to the added concrete grout material and the jacket.

Figure 12:
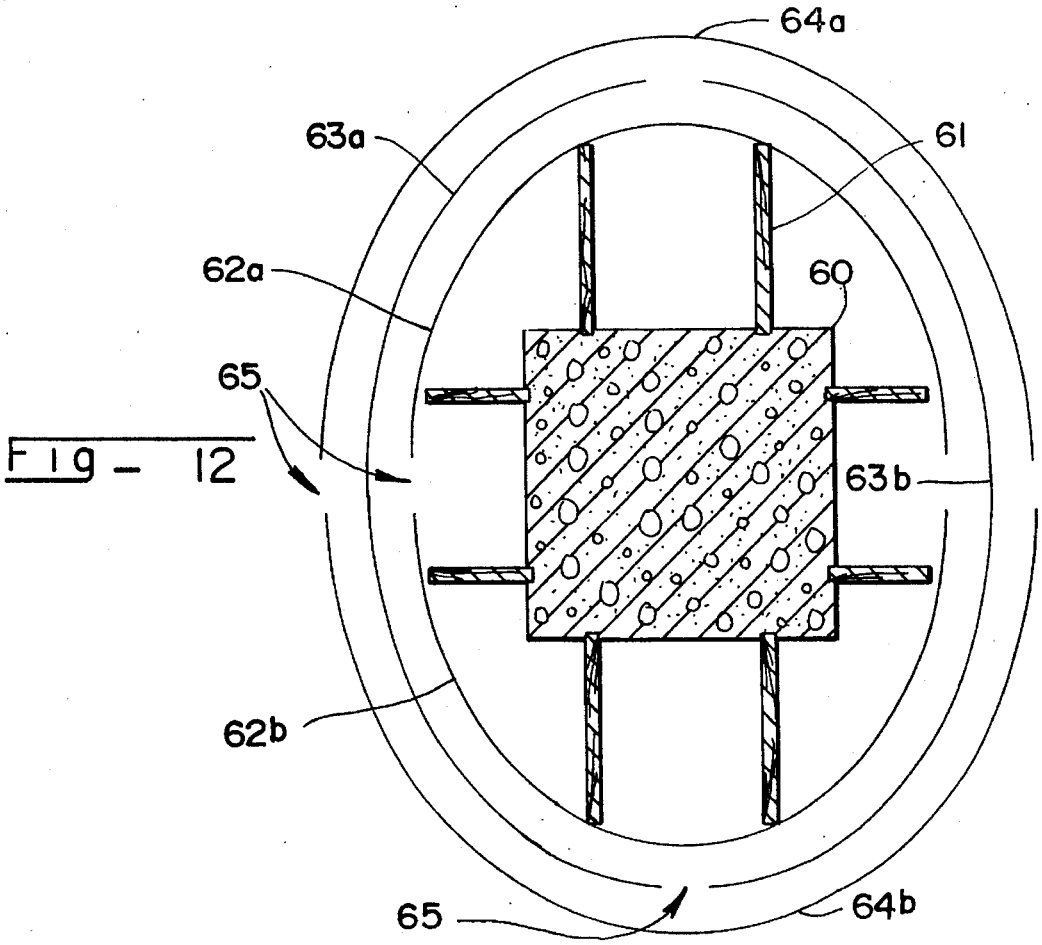
FIG. 12 is a cross sectional view of square column retrofitted with an oval jacket system and grouted.

To accomplish the assembly procedure, as shown in FIG. 12, the original square column 60 is fitted with stations 61 constructed of a suitable material e.g., plywood, steel, or composites, to create a column of the desired shape, here oval-shaped. The engineering material pieces are then applied over the stations in layers as detailed above. In the exoskeleton shown in FIG. 12, the gaps 65 in the first layer 62*a* and 62*b* are not aligned with those in the second layer 63*a* and 63*b* which are not aligned with those in the third layer 64*a* and 64*b*. The adhesive (not shown) located between the first and second layers and between the second and third layers is allowed to cure by applying pressure as shown in FIGS. 2*a* and 2*b* above. Once the cure is complete, grout openings(not shown) are fitted through the jacket at locations along the height of the jacket. Concrete grout(not shown) is then pumped into the void between the assembled jacket and the original column 60, filling the void.

The rotation of the seams in all cases creates a lap joint. The length of the lap joint is free to vary from layer to layer, but for optimum structural properties and safety factors, the lap shear area should be maximized.

The following equations and numbers describe how the required joint overlap length is calculated. The numbers used in the calculations relate to a twelve (12) inch high, six (6) inch diameter concrete cylinder reinforced with 0.046 inch thick composite layers (two (2) plies of 24 ounce woven roving impregnated with Dow 8084 vinyl ester resin) using CIBA-GEIGY's Araldite AV 8113 epoxy adhesive. The Tensile Strength of the Composite is tested and equals 50,000 psi. The Lap Shear Strength of the Adhesive is tested by making a lap shear coupon using the adhesive and the breaking it. Here the Lap Shear
Strength of the Adhesive is 2,500 psi.
Tensile Strength of the Composite (S)=50,000 psi
Thickness of Lap Joint Material (t)=0.046 in
Load Per Unit Width (P)=S*t=2,300 lb/in
Lap Shear Strength of the Adhesive (T)=2,500 psi
Joint Overlap=P/T=0.92 in (Safety Factor=1)

A small, single lap joint could be used, however, the multiple layers offers numerous advantages. The use of multiple (thin) layers with large surface areas leads to high safety factors. Using the numbers and results from the above equation, it is seen that a lap joint length of 0.92 inches is required. On this particular sample, the lap joint length can be optimized to 4.71 inches [(2*Pi*r)/4]. On a four foot (4 ft) diameter column, the optimized lap joint length is 37.7 inches. If the full length of the lap joint is adhered in both cases, the Safety Factors are 5 and 41, respectively. The Safety Factor should be at least 1.0 or the adhesive bond will be the weak link in the structure. Safety Factors of at least 4.0 are preferable.

Proper clamping techniques enable the installation of the layers with little air entrapment. However, the problems of air entrapment in the adhesive layers is not a major issue given the large safety factors already presented.

Also of note, if air is trapped, it is trapped in the adhesive layer and not in the composite reinforcing material. Thus, the air entrapment does not affect the process of this invention in the detrimental way that it affects other composite reinforcing processes (i.e. air in the composite affects the fiber to fiber load transfer and damage propagation mechanisms).

The most notable difference between this invention and others in the composite area is that the composite pieces in this invention are already formed to the desired shape and cured prior to their being placed on the load supporting structure being reinforced. This unique feature has three main benefits; an ability to exercise quality control over the pieces, the ability to tailor each piece to desired field installation weights by varying their thickness and length, and the ability to fabricate a variety of shapes to meet a wide variety of needs.

By producing the composite pieces in a controlled environment, a means of quality control can be implemented that can reject inferior composite reinforcements prior to their attachment to the elements in question. This ensures that only the highest quality, void free composite pieces are used to retrofit the elements. In the other methods, voids or deficiencies are only determined after the composite is cured onto the columns, and often they are unable to be corrected. This leaves the unpleasant choice of either removing the entire composite reinforcing layer or leaving a deficient reinforcing layer in use.

Tailoring the parts to specific thicknesses and field installation weights has two advantages. First, weights can be targeted such that it takes only one or two people, or very light equipment, to install the pieces on the element. Second, thin layers are flexible. This allows a single diameter piece to cover a variety of element sizes. The pieces are flexible enough to snugly fit the element, and the only change is in the gap width of the butt joint between same plane layers. As was shown earlier, the lap joint length is significantly over designed, so that an increased gap width does not have a detrimental affect on the reinforcing capability of the composite shell.

By fabricating a wide variety of shapes, objects such as overhead beams and square columns can be efficiently reinforced. Existing patents and processes are unable to effectively handle any object other than simple curved shapes that are accessible from 360 degrees (i.e. a round column). This invention allows for the reinforcement of virtually any size or shape of object in any location. This invention is particularly useful around column to beam joints. These areas typically suffer from cracking due to load and thermal cycling. Pre-molded, adhesively bonded, overlapping, items can effectively reinforce these areas with high tensile strength fibers to arrest the cracking.

EXAMPLE

In order to gain data on the performance of this invention, several standard ASTM compression tests were run on 6 (six) inch diameter, 12 (twelve) inch high concrete test cylinders. Concrete column stubs were cast to standard sizes of 152.4 mm (6 inch) diameter and 304.8 mm (12 inch) height using a mix ratio of 1:3:6:6 (water:cement:sand:aggregate by mass). The specimens were allowed to cure for 28 days before further use. The mix was found to have a 28 day average strength of 38.21N/mm squared (5542 psi) with a secant modulus of 29.24 kN/mm squared ($4.24\times 10^6$ psi). The column stubs were then wrapped with dry fabric as per Table 1, resin impregnated using the Resin Infusion technique as referred in U.S. Pat. No. 4,902,215. ( Samples 1 and 2) and the composite shell approach (Samples 3 and 4). Tables 1 and 2 outline the fabric architecture and the performance results of the test cylinders, respectively. Table 3 outlines the various components in the resin system used in all composite articles, whether resin infused or pre-cured and bonded on.

TABLE 1

| No. | Description of Wrap |
|---|---|
| 1 | 2 Plies of 24 oz. Woven Roving/Vinyl ester (Dow 8084) |
| 2 | 4 Plies of 24 oz. Woven Roving/Vinyl ester (Dow 8084) |
| 3 | 2 Layers (4 Plies) of 24 oz. Woven Roving/Vinyl ester (8084) |
| 4 | 3 Layers (6 Plies) of 24 oz. Woven Roving/Vinyl ester (8084) |

TABLE 2

| No. | Average Load at Failure (kN) | Average Deformation (mm) |
|---|---|---|
| 1 | 1023.95 | 2.95 |
| 2 | 1353.30 | 2.92 |
| 3 | 1525.00 | 3.82 |
| 4* | 1800.00 | 5.00 |

*Machine test limit

TABLE 3

| Component | Proportion |
|---|---|
| Vinyl ester (Dow 8084) resin | 100 parts |
| CoNap (Cobalt napthenate) | 0.3% |
| DMA (Dimethylaniline) | 0.6% |
| MEKP (methyl-ethyl-ketone-peroxide) | 2.3% |

After infusion the wrapped column stubs were allowed to achieve full cure of the composite at room temperature over 72 hours. All of the column stubs were tested in axial compression until failure. The ends of the stubs were ground to provide a flat and true surface before testing. Deformation data was collected using a dial gauge indicator. Results in terms of load and deformation at failure are given in Table 2. In each case the percentage increase was computed as:

$$\frac{\text{Specimen value} - \text{Control value}}{\text{Control value}} \times 100$$

As can be seen from the data in Table 2, the results of the composite reinforcement using the method described within this invention shows outstanding performance. From this table we see that this process is not only inexpensive and fast, but also extremely efficient in a reinforcing capacity. The pieces of this invention (Numbers 3 and 4) have the added benefits of the absence of wrinkles and a straighter fiber orientation versus the 'on the column' manufactured pieces. These quality improvements manifest themselves clearly in data point No. 3 where strength increases of 13% vs No. 2 and 50% vs No. 1 were achieved.

What is claimed is:

1. A process for reinforcing a load supporting structure around its exposed perimeter with a pre-cured composite shell comprising:

(a) placing a first layer of at least one distinct pre-cured composite piece around said exposed perimeter of said load supporting structure;

(b) applying an adhesive substance between said piece and said structure; and (c) exerting pressure on said shell until the adhesive cures wherein each pre-cured composite piece is preformed with a shape complementary to the exposed perimeter of the load supporting structure, (d) placing at least one additional layer of at least one distinct pre-cured composite piece around the exposed perimeter of said load supporting structure and first layer of at least one pre-cured composite piece and applying an adhesive substance between said layers.

2. The process of claim 1 wherein said at least one composite piece within the same layer is joined together at at least one joint and wherein said at least one joint on at least one additional layer is not aligned with said at least one joint on said first layer.

3. The process of claim 2 wherein said at least one joint on said first layer and said at least one joint on at least one additional layer form a joint overlap having a Safety Factor of at least 1.0.

4. The process of claim 3 wherein each layer contains at least two composite pieces.

5. The process of claim 3 wherein each composite piece covers less than 360° of said exposed perimeter.

6. The process of claim 2 wherein each layer of at least one composite piece covers less than 360° of said exposed perimeter.

7. The process of claim 6 wherein said at least one joint on at least on additional layer form a joint overlap having a Safety Factor of at least 4.0.

8. The process of claim 2 wherein said composite pieces are arc-shaped.

9. The process of claim 2 wherein said composite pieces are angular-shaped.

10. The process of claim 2 further comprising certifying said composite pieces before placing them around the exposed perimeter of said load supporting structure.

11. The process of claim 2 further comprising placing a barrier between said load supporting structure and said adhesive substance and adhering the adhesive substance to said barrier.

12. The process of claim 11 wherein said barrier is a release film.

13. The process of claim 2 wherein said adhesive substance is applied to each piece prior to placing said piece around the perimeter of said structure.

14. The process of claim 2 further comprising means to marginally seal said layers to said load supporting structure forming a sealed system; means to introduce an adhesive into said sealed system; means for introducing a vacuum into said system whereby the adhesive substance can fill said system such that the composite layers become bonded to each other and said structure.

15. The process of claim 1 wherein said first layer of at least one composite piece covers less than 360° of said exposed perimeter.

16. The process of claim 1 wherein at least two distinct pre-cured composite pieces of said first layer are placed over a first portion and at least one adjoining portion of said exposed perimeter over the length of said load supporting structure.

17. The process of claim 16 wherein said at least one composite piece within the same layer and for each adjoining portion is joined together at at least one joint and wherein said at least one joint on at least one additional layer is not aligned with said at least one joint on said first layer and wherein said at least one joint on said adjoining portion is not aligned with said at least one joint on said first portion.

18. The process of claim 1 wherein a distinct first precured composite piece is placed as part of said first layer around said exposed perimeter of said load supporting structure and further comprising placing a plurality of pre-cured composite pieces in succession first adjacent to said first composite piece and then adjacent to each succeeding composite piece around said structure and said first and succeeding composite pieces, and wherein said composite pieces form at least two layers and each composite piece is joined together with each succeeding composite piece at a joint and wherein each joint on at least one additional layer is not aligned with each joint on said first layer.

19. The process of claim 18 wherein each composite piece covers less than 360° of said exposed perimeter.

20. A reinforced load supporting structure comprising:

(a) An inner load supporting structure having an exposed perimeter;

(b) A first layer around said exposed perimeter of said load supporting structure having at least one distinct piece of preformed engineering material having high tensile strength and high modulus;

(c) At least one additional layer around said exposed perimeter of said load supporting structure and said first layer, having at least one distinct piece of preformed engineering material having high tensile strength and high modulus wherein each piece of engineering material is joined together at at least one joint and wherein said at least one joint on at least one additional layer is not aligned with said at least one joint on said first layer; and (d) An adhesive substance adhering said layers of at least one distinct piece of engineering material wherein each piece of engineering material is preformed with shape complementary to the exposed perimeter of the load supporting structure.

21. The reinforced load supporting structure set forth in claim 20 wherein said pieces of engineering material are precured composites.

22. The reinforced load supporting structure set forth in claim 20 wherein said joints on said first layer and said joints on at least one additional layer form a joint overlap having a Safety Factor of at least 1.0.

23. The reinforced load supporting structure set forth in claim 22 wherein said first layer of engineering material covers less than 360° of said exposed perimeter.

24. The reinforced load supporting structure set forth in claim 23 wherein said pieces of engineering material are precured composites.

25. The reinforced load supporting structure set forth in claim 22 wherein said pieces of engineering material are arc-shaped.

26. The reinforced load supporting structure set forth in claim 22 wherein said pieces of engineering material are angular-shaped.

27. The reinforced load supporting structure set forth in claim 22 wherein said first layer is adhered to said exposed perimeter of said inner load supporting structure.

28. The reinforced load supporting structure set forth in claim 20 wherein at least two distinct pieces of engineering material of said first layer are placed over a first portion and at least one adjoining portion of said exposed perimeter over the length of said load supporting structure.

29. The reinforced load supporting structure set forth in claim 28 wherein each piece of engineering material within the same layer and for each adjoining portion is joined together at at least one joint and wherein each joint on said adjoining portion is not aligned with each joint on said first portion.

30. The reinforced load supporting structure set forth in claim 29 wherein each piece of engineering material covers less than 360° of said exposed perimeter.

31. The reinforced load supporting structure set forth in claim 30 wherein said joints on said first layer and said joints on at least one additional layer form a joint overlap having a Safety Factor of at least 4.0.

32. The reinforced load supporting structure set forth in claim 20 wherein each layer contains at least two pieces of engineering material.

33. The reinforced load supporting structure set forth in claim 20 further comprising a means for separating said first layer of engineering material from said exposed perimeter of said load supporting structure.

34. The reinforced load supporting structure set forth in claim 33 wherein said separating means is a release film.

35. The reinforced load supporting structure set forth in claim 33 wherein said separating means is a physical barrier including a grouting material, 36. The reinforced load supporting structure set forth in claim 20 wherein a distinct first preformed piece of engineering material is part of said first layer and a plurality of preformed pieces of engineering material are in succession first adjacent to said first piece of engineering material and then adjacent to each succeeding piece of engineering material around said structure and said first and succeeding pieces of engineering material.

37. The reinforced load supporting structure set forth in claim 36 wherein said pieces of engineering material form at least two layers and each piece of engineering material is joined together with each succeeding piece of engineering material at a joint and wherein each joint on at least one additional layer is not aligned with each joint on said first layer.

38. The reinforced load supporting structure set forth in claim 37 wherein each piece of engineering material covers less than 360° of said exposed perimeter.

39. A process for reinforcing a load supporting structure around its exposed perimeter comprising:

(a) placing a first layer of at least one distinct piece of preformed engineering material having high tensile strength and high modulus around said exposed perimeter of said load supporting structure;

(b) placing at least one additional layer of at least one distinct piece of preformed engineering material having high tensile strength and high modulus around said exposed perimeter of said load supporting structure and said first layer, wherein said at least one piece or engineering material is joined together at at least one joint and wherein said at least one joint on at least one additional layer is not aligned with said at least one joint on said first layer;

(c) applying at adhesive substance between said layers of at least one distinct piece of engineering material; and (d) curing said adhesive wherein each piece of engineering material is preformed with shape complementary to the exposed perimeter of the load supporting structure.

40. The process set forth in claim 39 further comprising means for separating said first layer of engineering material from said exposed perimeter of said load supporting structure.

41. The process set forth in claim 40 further comprising grouting the separation between said exposed perimeter of said load supporting structure and said first layer of engineering material.

42. The process set forth in claim 41 wherein each composite piece covers less than 360° of said exposed perimeter.

43. The process set forth in claim 39 wherein said engineering material is a pre-cured composite and said curing means comprises exerting pressure on said layers until the adhesive cures.

44. The process set forth in claim 43 wherein each joint on said first layer and each joint on at least one additional layer form a joint overlap having a Safety Factor of at least 1.0.

* * * * *

Adverse Decision In Interference

Patent No. 5,505,030, William W. Michalcewiz, George C. Tunis, III, Rikard K. Haraldsson, and Brock J. Vinton, COMPOSITE REINFORCED STRUCTURES, Interference No. 104,548, final judgment adverse to the patentees rendered February 13, 2002, as to claims 1, 2, 6, 8, 9, 13, 15-22, 25, 26, 28-30, 32, 36-39, and 43.

*(Official Gazette March 19, 2002)*